US009121172B2

(12) United States Patent
Sato et al.

(10) Patent No.: US 9,121,172 B2
(45) Date of Patent: Sep. 1, 2015

(54) WALL PANEL FASTENING STRUCTURE

(71) Applicant: Kikukawa Kogyo Co., Ltd., Sumida-Ku, Tokyo (JP)

(72) Inventors: Katsuo Sato, Chiba (JP); Tadao Minuma, Chiba (JP)

(73) Assignee: Kikukawa Kogyo Co., Ltd., Tokyo (JP)

( * ) Notice: Subject to any disclaimer, the term of this patent is extended or adjusted under 35 U.S.C. 154(b) by 0 days.

(21) Appl. No.: 14/143,734

(22) Filed: Dec. 30, 2013

(65) Prior Publication Data

US 2015/0089899 A1 Apr. 2, 2015

(30) Foreign Application Priority Data

Oct. 1, 2013 (JP) ..... 2013-206240

(51) Int. Cl.
*E04C 2/00* (2006.01)
*E04B 2/72* (2006.01)
*E04C 2/30* (2006.01)

(52) U.S. Cl.
CPC .. *E04B 2/721* (2013.01); *E04C 2/30* (2013.01)

(58) Field of Classification Search
CPC ..... E04B 2/721; E04C 2/30
USPC ..... 52/782.1, 506.05, 745.21, 202, 203, 52/782.23
See application file for complete search history.

(56) References Cited

U.S. PATENT DOCUMENTS

| | | | | |
|---|---|---|---|---|
| 6,668,514 | B2 * | 12/2003 | Skov | 52/782.1 |
| 7,383,667 | B2 * | 6/2008 | Jung | 52/235 |
| 7,854,099 | B2 * | 12/2010 | Kidd | 52/489.1 |
| 2012/0017530 | A1 | 1/2012 | Hummel, III | |

FOREIGN PATENT DOCUMENTS

| | | | |
|---|---|---|---|
| AT | 512 295 | A4 | 7/2013 |
| CH | 685788 | A5 | 9/1995 |
| DE | 89 09 856 | U1 | 10/1989 |
| DE | 10 2007 004 490 | A1 | 7/2008 |
| DE | 20 2009 012 272 | U1 | 1/2011 |
| JP | 2006-104735 | | 4/2006 |
| JP | 2006-104735 | | 4/2013 |

OTHER PUBLICATIONS

English-language translation of DE 20 2009 012 272 U1, submitted as document B2 in the Information Disclosure Statement filed on Nov. 3, 2014 (seven (7) pages).
English-language translation of DE 89 09 856 U1, submitted as document B3 in the Information Disclosure Statement filed on Nov. 3, 2014 (seven (7) pages).
German Office Action dated Sep. 19, 2014, including partial English translation (seven (7) pages).

* cited by examiner

*Primary Examiner* — Basil Katcheves
(74) *Attorney, Agent, or Firm* — Crowell & Moring LLP

(57) ABSTRACT

A wall panel fastening structure for mounting and demounting each panel without moving the other panels is provided on a supporting frame by using a projecting and retracting pin, wherein the wall panel is provided with a wall board part and a fastening part projecting on a back surface of the wall board part; the supporting frame is provided with an accommodating space for accommodating the projecting and retracting pin, and placed along a gap between adjacent wall panels and facing the fastening part; the accommodating space is open to the gap; the projecting and retracting pin is provided with a thread portion and screwed into a thread hole provided in a flange of the supporting frame; and the wall panel is locked to the supporting frame by inserting a front end portion of the projecting and retracting pin into a locking hole formed in the fastening part.

12 Claims, 9 Drawing Sheets

WALL PANEL FASTENING STRUCTURE

CROSS REFERENCE TO RELATED APPLICATIONS

The present application is based upon and claims the benefit of priority of Japanese Patent Application No. 2013-206240, filed on Oct. 1, 2013, the entire contents of which are incorporated herein by reference.

BACKGROUND OF THE INVENTION

1. Technical Field

The invention relates to a wall panel fastening structure.

2. Background Art

A conventional structure to fasten a panel used for a wall or the like generally has a configuration in which a locking piece provided on the panel is locked to a supporting piece provided on a structural body. Either one of the locking piece and the supporting piece is provided with a projecting portion vertically protruding. The other one is provided with a depressed portion or a hole into which the projecting portion is fit. Hanging and lowering the panel from the upper side has the projecting portion fit in the depressed portion or the hole, and fixing the locking piece to the supporting piece has the panel supported in the vertical direction and fastens the panel in the horizontal push-pull direction (direction perpendicular to the panel), as described in, for example, the patent document 1.

RELATED TECHNICAL DOCUMENTS

Patent Document

[Patent Document 1]

Japanese Laid-open Patent Application JP2006-104735

SUMMARY OF THE INVENTION

Problems to be Solved by the Invention

In the wall panel fastening structure mentioned above, fixing the locking piece of the panel to the supporting piece requires moving the panel vertically without horizontally shifting the panel from the position in which the panel is pushed against the mounting surface. The distance of this vertical movement is greater than the distance between the vertically adjacent panels. Therefore, demounting a panel located in the lower direction for a purpose of exchange or the like, requires sequentially demounting panels in the order of the upper to the lower, thus causes a problem of requiring much time and man-power.

Therefore, the present invention has been made to solve the above problem, and an object of the present invention is to provide a wall panel fastening structure which enables mounting and demounting a panel without moving the other panels.

Solution to the Problem

The first aspect of the invention, in order to solve the above problems, provides a wall panel fastening structure including a wall panel, a supporting frame, and a projecting and retracting pin, in which the wall panel is to be fastened to the supporting frame by using the projecting and retracting pin, and is provided with a wall board part and a fastening part projecting from a back surface of the wall board part; the supporting frame is provided with an accommodating space for accommodating the projecting and retracting pin, and placed along a gap between adjacent wall panels and facing to the fastening part; the accommodating space is open to the gap; the projecting and retracting pin is provided with a thread portion and screwed into a thread hole provided in a flange of the supporting frame; and the wall panel is locked to the supporting frame by inserting a front end portion of the projecting and retracting pin into a locking hole formed in the fastening part.

The supporting frame is composed of a pillar body, a rod-like member or a bracket attached to a pillar or an underslab wall, or the like. According to the configuration mentioned above, since the wall panel is configured to be locked by projecting and retracting the projecting and retracting pin accommodated in the supporting frame, the lock of the wall panel can be released without shifting other wall panels. Accordingly, even a lower wall panel located on the lower side can be mounted and demounted individually. In the addition, since the accommodating space is open to the gap, the projecting and retracting pin can be projected and retracted by rotating the projecting and retracting pin through the gap from the front surface of the wall panel.

According to a second aspect of the invention, in the wall panel fastening structure, a head of the projecting and retracting pin is provided with a gear configured to project and retract the projecting and retracting pin by inserting a rotation jig having teeth meshing with the gear into the accommodating space through the gap from the outside of the gap and by rotating the projecting and retracting pin. According to the above configuration, even if the width of the gap is narrow, by inserting a plate-shaped jig having teeth meshing with the gear into the accommodating space through the gap the projecting and retracting pin can be rotated.

According to a third aspect of the invention, the thread hole is formed in a pin-supporting member provided with a boss portion that is separated from the supporting frame; and the pin-supporting member is attached to a flange of the supporting frame. Such a configuration makes it easy to form the thread hole of the supporting frame that is elongated member.

According to a fourth aspect of the invention, the supporting frame is provided with a supporting piece overhanging in the horizontal direction; the wall panel is provided on the back side of the wall board part with a vertical-position-adjusting mechanism received by the supporting piece; an abutting surface of the vertical-position-adjusting mechanism abutting with the supporting piece is configured to be movable up and down; the projecting and retracting pin is accommodated in the supporting frame extending in the vertical direction and disposed so as to project and retract in the horizontal direction; and the locking hole is an elliptic hole elongated long in the vertical direction. The above configuration enables adjusting the vertical position of the wall panel, and further securing the vertical position adjustment margin by making the locking hole an elongated hole.

According to a fifth aspect of the invention, the vertical-position-adjusting mechanism is provided with a bolt member extending in the vertical direction, and a thread-hole member into which the bolt member screws; and the abutting surface is provided on a front end portion of the bolt member. The above configuration allows simple adjustment of the vertical position of the wall panel only by rotating the bolt member.

Advantageous Effect of the Invention

According to the wall panel fastening structure of the present invention, it is possible to mount and demount a panel without moving the other panels.

BRIEF DESCRIPTION OF THE DRAWINGS

FIG. 6A is a side view as seen along the axis direction. FIG. 6B is a side view as seen from the direction perpendicular to the axis direction.

FIG. 7A is a side view as seen along the axis direction from a boss portion of the pin-supporting member, FIG. 7B is a side view as seen from the direction perpendicular to the axis direction, and FIG. 7C is a side view as seen along the axis direction from a flange of the pin-supporting member.

DESCRIPTION OF EMBODIMENTS OF THE INVENTION

Figure 1:
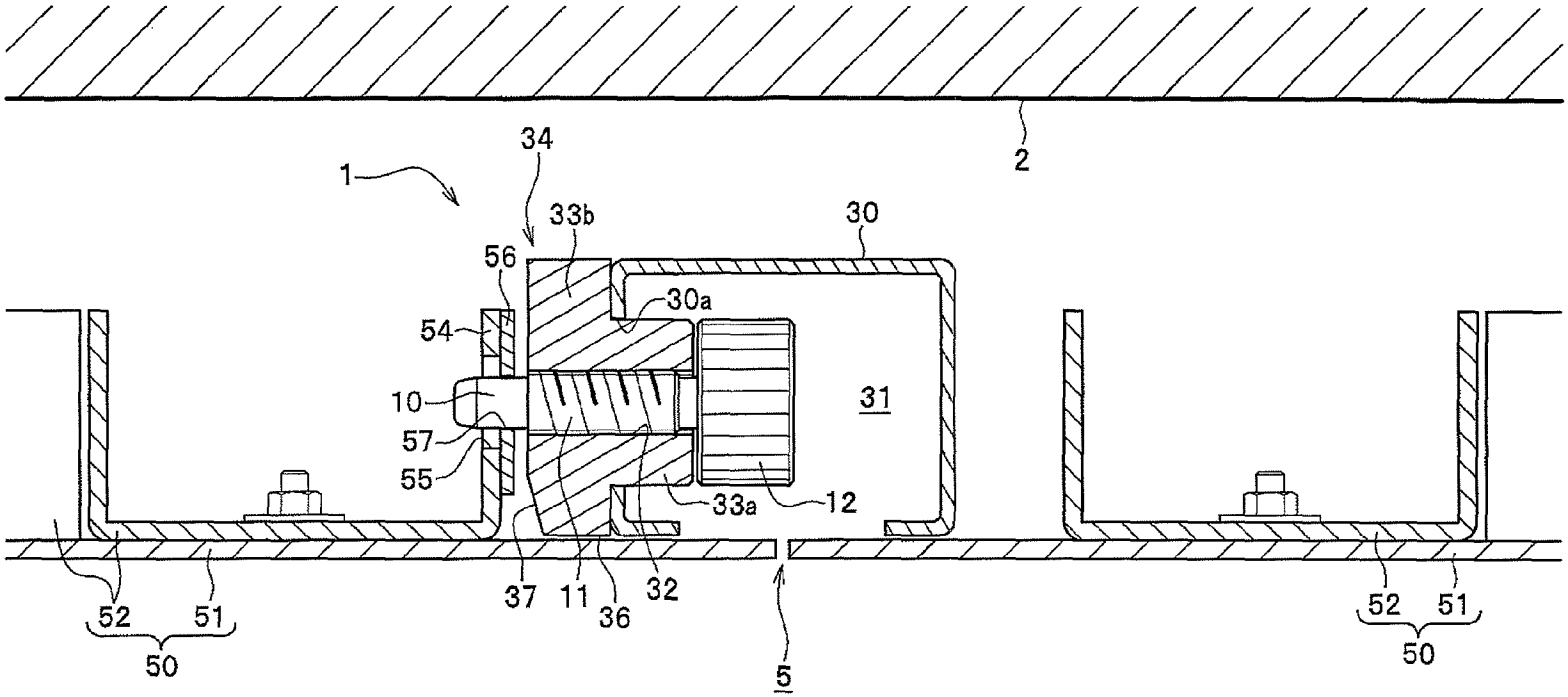
FIG. 1 is a horizontal sectional view showing a main part of a wall panel fastening structure according to an embodiment of the present invention.
Figure 2:
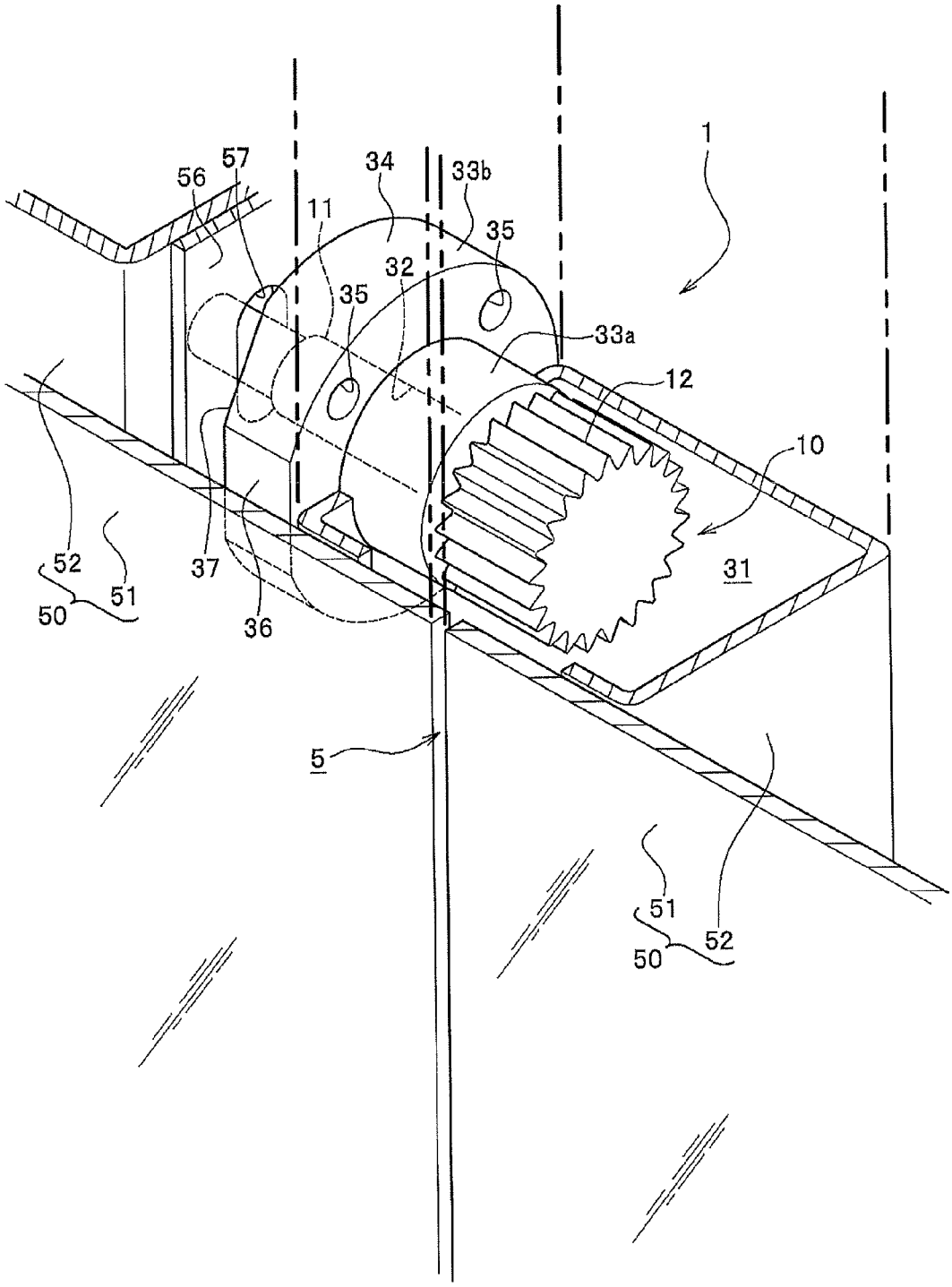
FIG. 2 is a perspective view showing a main part of the wall panel fastening structure according to the embodiment of the present invention.

With reference to the drawings, embodiments of the invention are described in detail. As shown in FIG. 1 and. FIG. 2, the wall panel fastening structure 1 according to the present embodiment is a structure that mounts a wall panel 50 for an inner wall to a supporting frame 30 using a projecting and retracting pin 10 provided with a thread portion 11.

As shown in FIG. 1, the supporting frame 30 is formed by a pillar member that is fixed to an underslab wall 2. The supporting frame 30 is composed of lip-channel steel and an inner space thereof is an accommodating space 31 for the projecting and retracting pin 10. The supporting frame 30 has an opening between lips. The opening faces a gap 5 between adjacent wall panels 50, thereby making the accommodating space 31 open to the gap 5.

Figure 8:
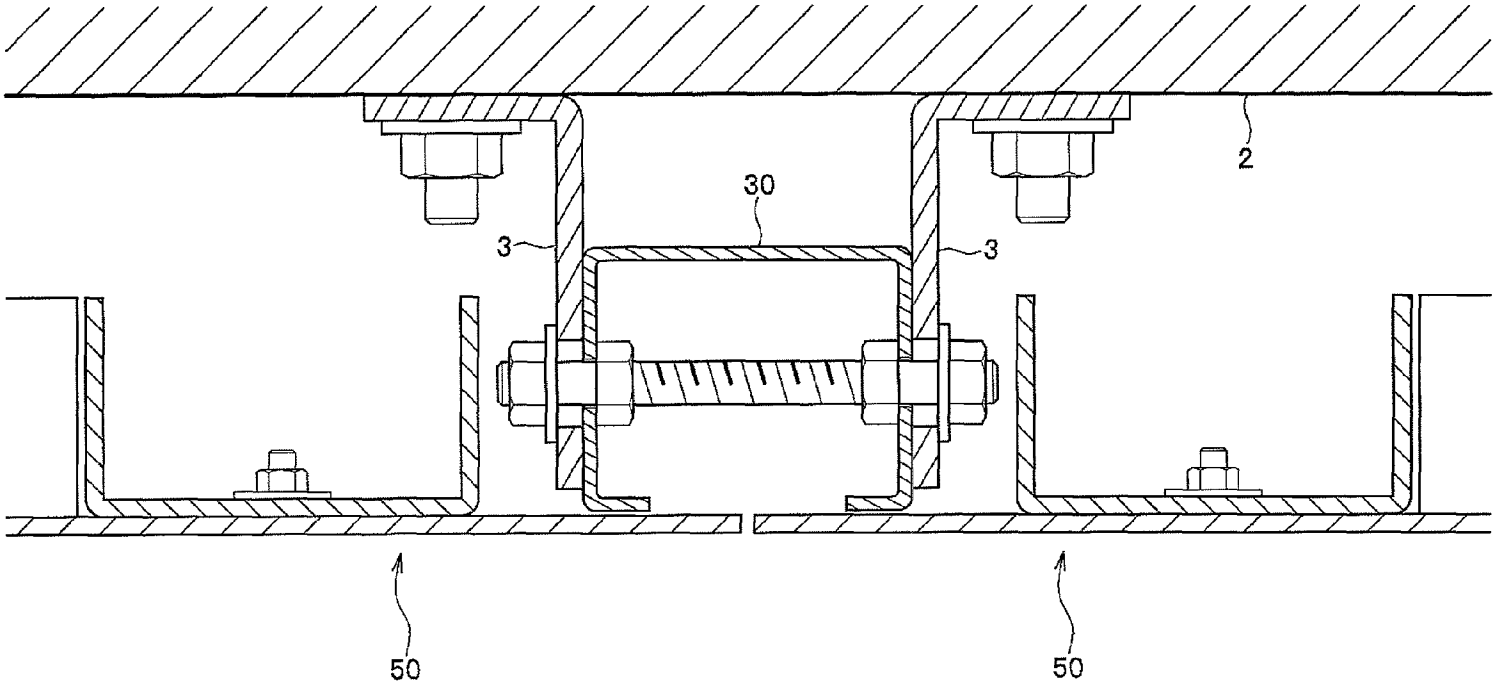
FIG. 8 is a plan view showing a fastening structure of a supporting frame and an underslab wall surface.

As shown in FIG. 8, the supporting frame 30 is fastened to the underslab wall 2 via an L-shaped bracket 3. The brackets 3 are provided in pairs for each portion for support of the supporting frame 30 so as to sandwich the supporting frame 30 from the both sides thereof. One side of the bracket 3 is fastened by a bolt to abut on the underslab wall 2. The other side of the bracket 3 comes into contact with a flange surface of the supporting frame 30, and is fastened to the supporting frame 30 by a through-bolt together with the same side of another bracket 3 being contacted with the opposite flange surface of the supporting frame 30.

As shown in FIG. 1, a flange of the supporting frame 30 is provided with a thread hole 32 into which the projecting and retracting pin 10 screws. The thread hole 32 is formed in the pin-supporting member 34 having a boss portion 33*a* that is a member separate from the supporting frame 30. A central axis of the thread hole 32 extends horizontally and parallel to the surface of the wall panel 50. The thread hole 32 is formed so that an extending line of the axis thereof intersects the flange of the frame member 52 of the wall panel 50. The thread holes 32 are formed on each of the flanges in both sides of the supporting frame 30 to lock the projecting and retracting pins to both of the adjacent wall panels 50. A pair of thread holes 32 each formed in one of both flanges of the supporting frame 30 is arranged vertically apart from each other in order to prevent interference between the projecting and retracting pins 10.

Figure 7A:
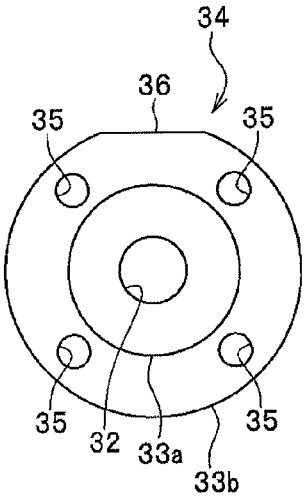
FIG. 7A, FIG. 7B, and 7C are diagrams showing a pin-supporting member where
Figure 7B:
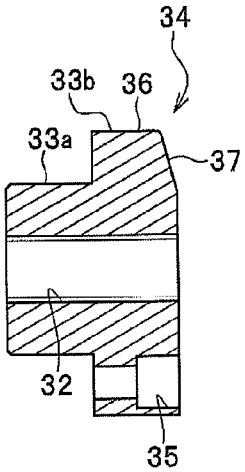
Figure 7C:
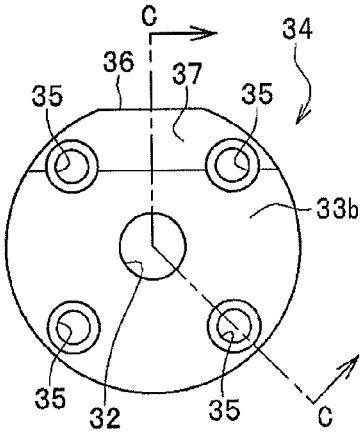

As shown in FIG. 1 and FIGS. 7A, 7B, and 7C, the pin-supporting member 34 is provided with a boss portion 33*a* and a flange portion 33*b* formed integrally with the boss portion 33*a*. Note that FIG. 7B is a sectional view taken along the line C-C in FIG. 7C. The thread hole 32 is formed through the boss portion 33*a* and the flange portion 33*b* (refer to FIG. 7B). The flange portion 33*b* has a plurality of bolt holes 35 formed on the same circumference line with an equal angular pitch. The flange portion 33*b* has an outer peripheral shape of a substantially circle of which a portion is cutout in a plane. A planate cutout portion 36 is arranged to be positioned on the same plane as the lip end surface of the supporting frame 30. In the place where the cutout portion 36 is formed, a slant surface 37 is formed on the flange portion 33*b* so that the flange portion 33*b* becomes thinner as getting near the cutout portion 36.

As shown in FIG. 1, the pin-supporting member 34 is inserted to be attached into a through-hole 30*a* formed in the flange of the supporting frame 30. Specifically, the boss portion 33*a* is inserted into the through-hole 30*a* from the outside of the supporting frame 30, and the flange portion 33*b* abuts on the outer surface of the supporting frame 30. Then, the distal end portions of bolts inserted into the bolt holes 35 of the flange portion 33*b* are screwed to the flange of the supporting frame 30, thereby fastening the pin-supporting member 34 to the supporting frame 30. When mounting the pin-supporting member 34, the slant surface 37 is positioned to face the front surface of the wall panel 50 by placing the cutout portion 36 of the flange portion 33*b* along the lip-side end surface of the supporting frame 30.

The supporting frame 30 of the present embodiment is formed of the lip-channel steel, but is not limited thereto. The supporting frame 30 may be formed of other types of structural steel such as channel steel or H-shaped steel as long as it has an accommodating space therein and a side portion capable of being formed to have a thread hole. In addition, the supporting frame 30 of the present embodiment is a rod-like member extending in the vertical direction, but may be a member extending in the horizontal direction. In this case, the supporting frame is arranged along the gap (horizontal gap) between the vertically adjacent wall panels 50. Further, the supporting frame 30 of the present embodiment is a continuous rod-like member but may be a short-cut separate member which is provided at each place in which the projecting and retracting pin 10 is provided.

The wall panel 50 is provided with a wall board part 51 and a frame member 52 (fastening part) that protrudes to the back side of the wall board part 51. The wall board part 51 constitutes a surface material of the wall panel 50, made of a stainless steel plate which is surface-treated in the present embodiment. Note that the wall board part 51 is not limited to the stainless steel plate, and may be a plate of other material or may be a plate on a surface of which finishing material is applied in a different time from the wall-panel mounting.

Figure 5:
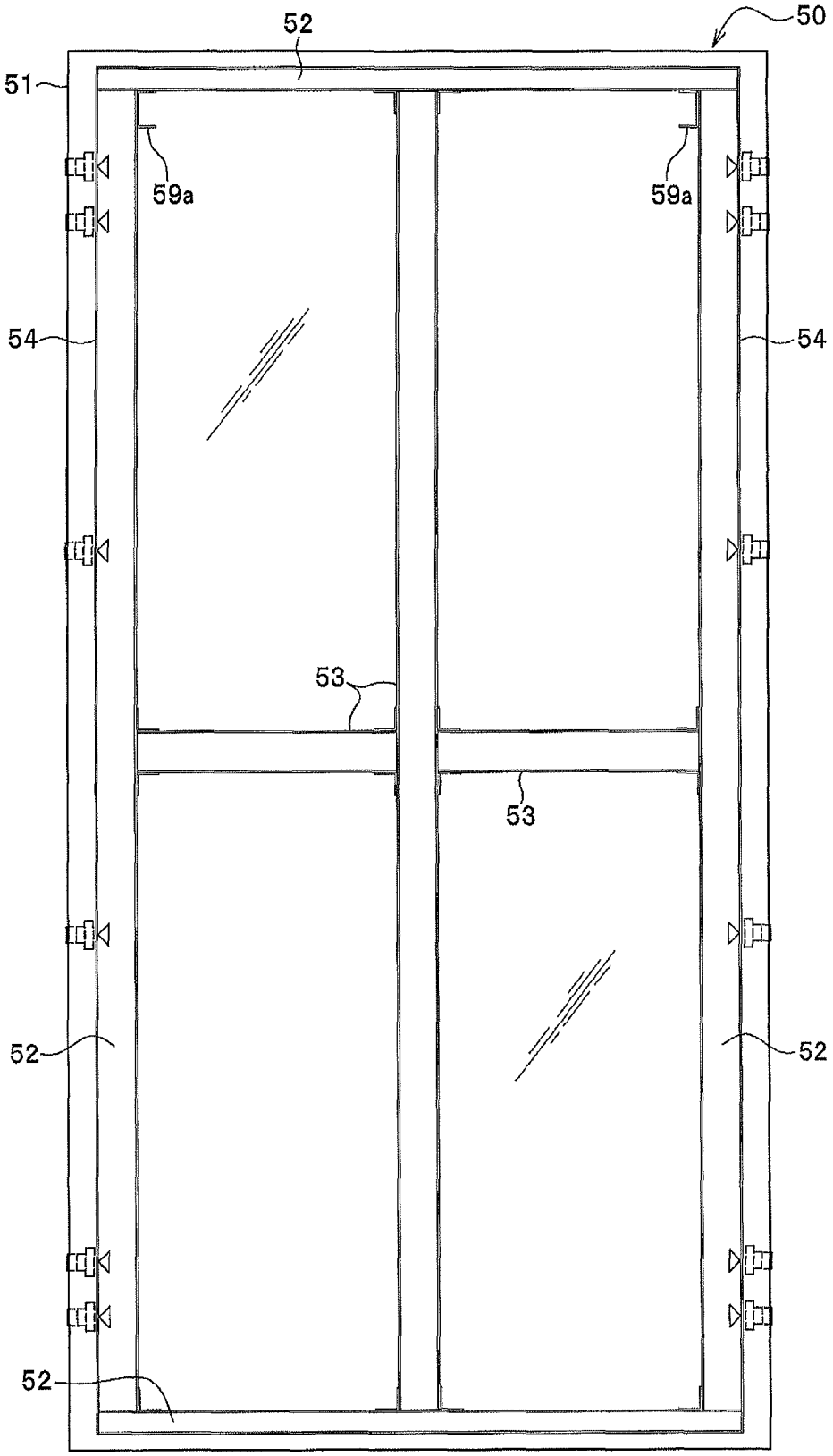
FIG. 5 is a side view showing the wall panel fastening structure according to the embodiment of the present invention.

As shown in FIG. 5, the frame member 52 is fixed in a frame shape along a peripheral edge portion of the back surface of the wall board part 51. The frame member 52 reinforces the wall board part 51 to keep the plane shape as well as serves as a member to connect the wall board part 51 with the supporting frame 30. The frame member 52 is disposed offset at a predetermined distance inward from the side edges of the wall board part 51 to secure a space for the supporting frame 30 in the back side of the side edge portion of the wall board part 51 (refer to FIG. 1). Within the frame member 52 of the frame-like shaped is attached a reinforcing frame 53 in cross shaped arrangement. The reinforcing frame 53 is provided appropriately according to the size and strength of the wall board part 51. Note that a member for coupling the wall board part 51 to the supporting frame 30 may not be frame-shaped as the frame member 52, but may be a small-piece member protruding on the back surface and provided depending on the mounting position of the projecting and retracting pin. In the case of the small-piece member, the member may be provided as a member separate from a frame member for reinforcement.

As shown in FIG. 1, the frame member 52 is made of channel-structured stainless steel, and the rear surface portion thereof abuts on the back surface of the wall board part 51. The frame member 52 is fastened via a bolt that is fixed by welding to the back side of the wall board part 51. The frame member 52 vertically extending is disposed in such a manner as to face the flange of the supporting frame 30. Among the flanges of the vertically extending frame member 52, the flange 54 that is located on the outer peripheral side of the panel has a through-hole 55 formed. The through-hole 55 exhibits a circular shape greater than the outer diameter of the end of the projecting and retracting pin 10.

A position-adjusting plate 56 is provided on the outside of the flange 54, and has a locking hole 57 formed. The locking hole 57 is arranged to overlap with the through-hole 55, formed to be an elongated hole extending in the vertical direction, and equivalent in width (width of an opening in the horizontal direction) to the outside diameter of the distal end portion of the projecting and retracting pin 10. The position-adjusting plate 56 is a member to offset a mounting tolerance of the projecting and retracting pin 10. The position-adjusting plate 56 adjusts the mounting position to the flange 54 depending on the position of the projecting and retracting pin 10 attached to the supporting frame 30 actually in the field, and also serves to reinforce the flange 54.

The distal end portion of the projecting and retracting pin 10 is inserted into the through-hole 55 and the locking hole 57 to be locked at the locking hole 57. In the present embodiment, the position-adjusting plate 56 having the locking hole 57 is attached to the flange 54, but the present invention is not limited thereto. The projecting and retracting pin 10 may be locked directly to a through-hole of the frame member 52 by making the width dimension of the through-hole of the frame member 52 equal to the outside diameter of the distal end of the projecting and retracting pin 10 to use the through-hole of the frame member 52 for a locking hole, without providing the position-adjusting plate 56.

The through-hole 55 and the locking hole 57 are formed respectively in the total of six positions that are portions corresponding to the mount positions of the projecting and retracting pins 10. The six positions include two points at the upper end, two points at the lower end, and two points at predetermined intervals between the upper and lower end (refer to the triangle marks in FIG. 5).

As shown in FIG. 1, the projecting and retracting pin 10 is made of a bolt member with the thread portion 11, and a head portion thereof is accommodated in the accommodating space 31. The thread portion (shaft portion) 11 of the projecting and retracting pin 10 extends horizontally and parallel to the surface of the wall panel 50 passing from the inside of the accommodating space 31 through the thread portion 11. The distal end portion of the thread portion 11 protrudes to the outside of the supporting frame 30 and faces the frame member 52. When the wall panel 50 is locked (when the projecting and retracting pin 10 is projected), the distal end portion of the thread portion 11 is inserted into the through-hole 55 and the locking hole 57 to be locked by the locking hole 57 (refer to the projecting and retracting pins 10 on the upper side in FIG. 3). On the other hand, when releasing the lock (when the projecting and retracting pin 10 is retracted), the distal end of the thread portion 11 is taken out from the through-hole 55 and the locking hole 57 (refer to the projecting and retracting pins 10 on the lower side in FIG. 3).

Figure 6A:
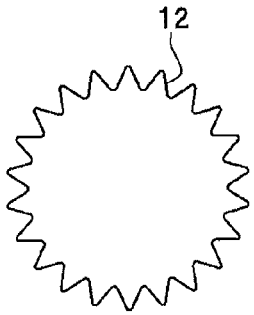
FIG. 6A and FIG. 6B are diagrams showing a projecting and retracting pin where
Figure 6B:
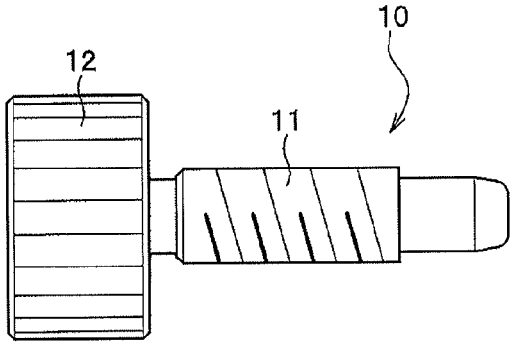

As shown in FIG. 6, the head of the projecting and retracting pin 10 is provided with a gear 12. The gear 12 is carved to form crests and valleys along the circumferential direction on the head of the projecting and retracting pin 10. The crests and valleys are formed parallel to the axial direction. Note that the gear 12 may be formed by fixing a cylindrical gear member to the head of the projecting and retracting pin 10. The length of the gear 12 in the axial direction is longer than the distance between the projecting and retracting positions of the projecting and retracting pin 10. The gear 12 is positioned at the front of the gap 5 (the position that is visible in the back of the gap 5 as viewed from the front side of the wall board part 51) in the accommodating space 31 both in the times of projecting and retracting of the projecting and retracting pin 10.

Figure 3:
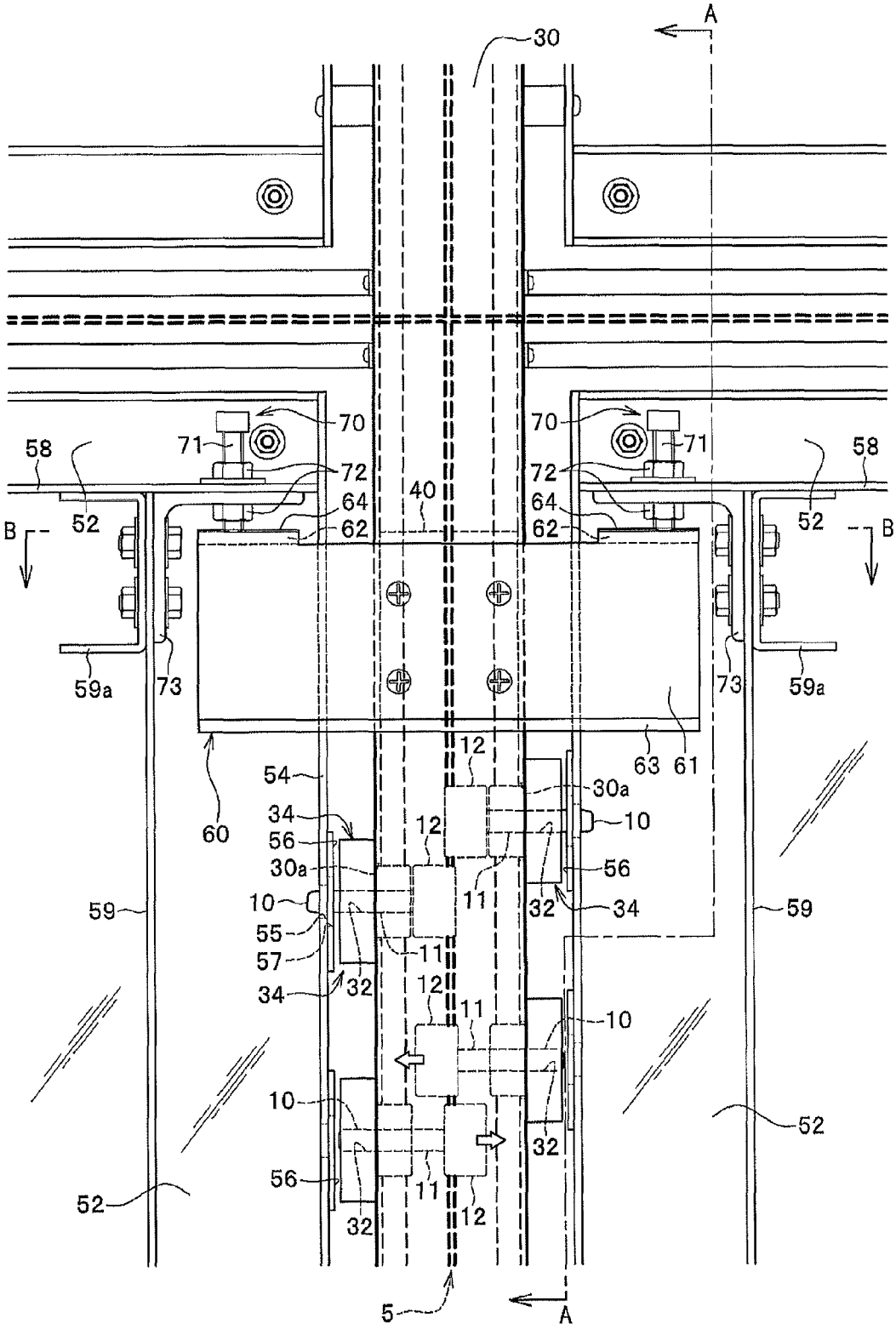
FIG. 3 is a side view of the wall panel fastening structure as seen from the inner side of a wall, according to the embodiment of the present invention.
Figure 4:
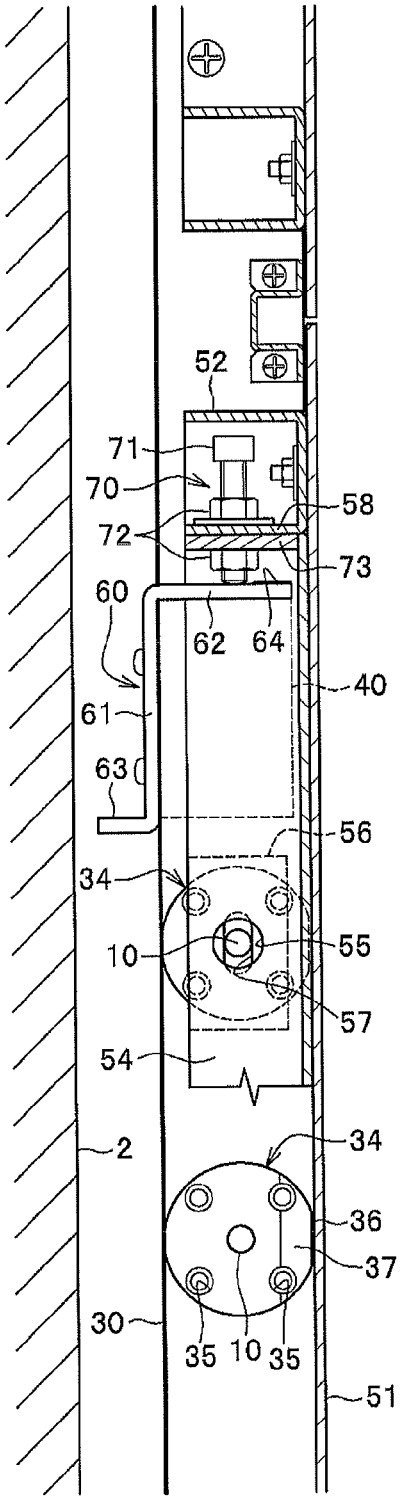
FIG. 4 is a sectional view taken along a line AA in FIG. 3.
Figure 9:
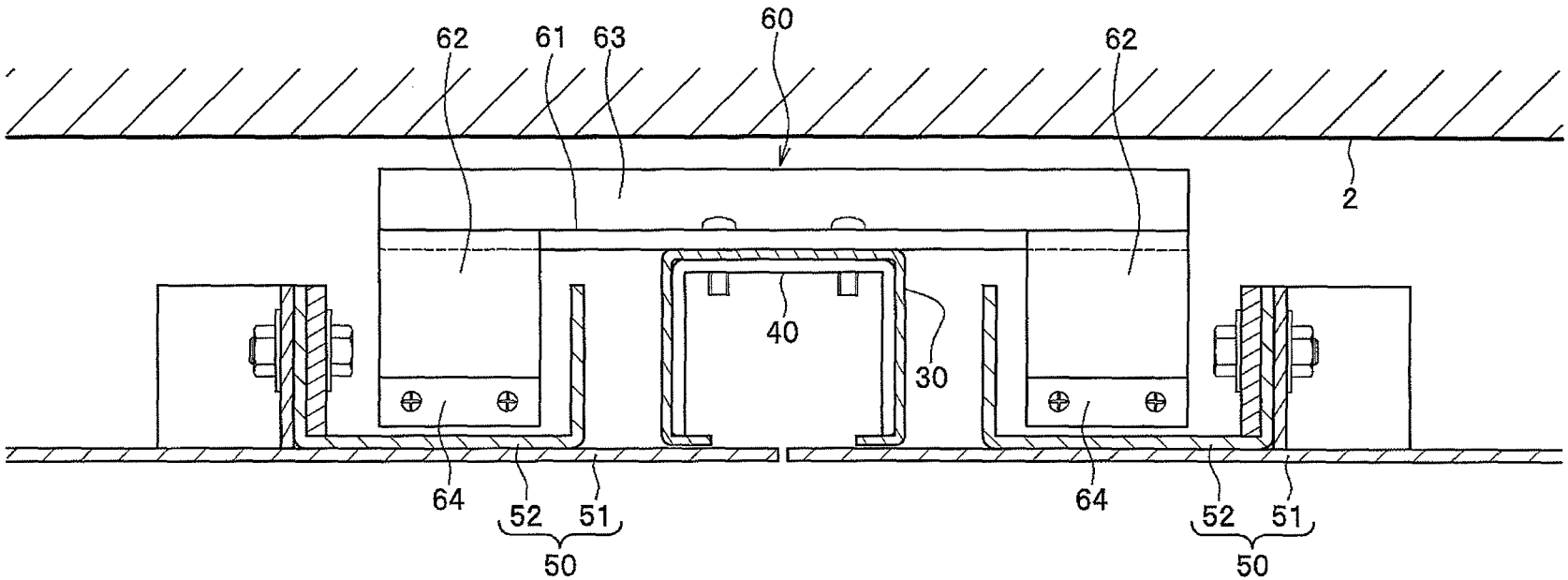
FIG. 9 is a plan view showing the supporting frame and a supporting piece.

In the wall panel fastening structure 1 of the present embodiment, as shown in FIGS. 3, 4, and 9, the supporting frame 30 is further provided with a supporting piece 60 overhanging in the horizontal direction, and the wall panel 50 is further provided with a vertical-position-adjusting mechanism 70 received by the supporting piece 60 on the back side of the wall board part 51. FIG. 9 is a cross-sectional view taken along the line BB in FIG. 3.

The supporting piece 60 is fixed to the outside of the rear surface of the supporting frame 30 at the vertical position corresponding to the upper end of the wall panel 50. The supporting piece 60 is provided with a fastening plate portion 61, a receiving plate portion 62, and a reinforcing plate portion 63. The supporting piece 60 is formed by bending a plate material of stainless steel, and the fastening plate portion 61, the receiving plate portion 62, and the reinforcing plate portion 63 are unified into one body.

The fastening plate portion 61 is a plate that is screwed to the rear portion of the supporting frame 30, has a rectangular shape elongating horizontally, and overhangs towards the frame members 52 in the both sides thereof from the supporting frame 30 that is positioned at a center of the fastening plate portion 61. Note that a reinforcing plate 40 having a U-shaped cross section is provided around the inner circumferential portion of the supporting frame 30 at the position to which the fastening plate portion 61 is fixed.

The receiving plate portion 62 is formed by being bent from the upper end of both ends of the fastening plate portion 61 toward the wall panel 50, and extends in the horizontal direction. The tip portion of the receiving plate portion 62 enters the inside of the frame member 52. The upper surface of the receiving plate portion 62 defines the receiving surface for the vertical-position-adjusting mechanism 70. On the distal end of the receiving plate portion 62 is laid a plate 64. The plate 64 is placed at the more distal end position than the vertical-position-adjusting mechanism 70, and acts as a stopper to prevent the vertical-position-adjusting mechanism 70 from moving forward the more distal end side than the right position.

The reinforcing plate portion 63 is formed by being bent forward the underslab wall 2 from the lower end of the fastening plate portion 61. The reinforcing plate portion 63 serves as a rib to reinforce the fastening plate portion 61.

The vertical-position-adjusting mechanism 70 is provided with a bolt member 71 extending vertically and a thread-hole member 72 to which the bolt member 71 screws.

The bolt member 71 is arranged to place the head thereof in the upper side. The bolt member 71 rotates to be moved up and down with respect to the thread-hole member 72. The shaft tip (the bottom end) of the bolt member 71 defines the contact surface to the receiving plate portion 62.

The thread-hole member 72 is placed at the position that is the end portion of the frame member 52 extending in the horizontal direction at the upper end portion of the wall panel 50 and that is the connection portion with the upper end of the frame member 52 extending in the vertical direction. The connection portion is provided with a reinforcing member 73 made of an angle member with an L-shaped cross section. The horizontal surface of the reinforcing member 73 abuts on a lower surface of a lower flange 58 of the frame member 52 extending in the horizontal direction. The vertical surface of the reinforcing member 73 abuts on an inner surface of an inner flange 59 of the inner peripheral side of the frame member 52 extending in the vertical direction. The vertical plate of the reinforcing member 73 is fastened to the inner flange 59 by a bolt together with a member of channel steel 59*a* abutting on the outer surface of the inner flange 59.

The thread-hole member 72 is made of a nut member provided on the lower flange 58. The nut members are provided on both of the upper and lower surfaces to sandwich the lower flange 58. The upper nut member is welded to the upper surface of the lower flange 58. The lower nut member is provided to the lower plate flange 58 through the horizontal plane of the reinforcing member 73 by being welded to the lower surface of the horizontal plane of the reinforcing member 73.

Hereinafter, the explanations are given of how to demount the wall panel 50 that is fastened using the wall panel fastening structure 1, and of the action and effects of the invention. In order to demount the wall panel 50 from the supporting frame 30, in a state in which the wall panel 50 is held by suctioning the wall panel 50 with a suction device such as a suction cup (not shown) at the front surface side of the wall panel 50, a rotating jig having teeth formed to mesh with the gear 12 is inserted from the gap 5 to rotate the gear 12. For example, the rotating jig provided with a thin plate of rack (linear gear) at a gear-grip portion is used. Then, the rack is inserted from the gap 5, meshed with the gear 12, and pushed and pulled. Note that the invention is not limited to the rack-shaped jig for a rotating jig. A disc-shaped gear may be used and partly inserted from the gap 5 to be meshed with the gear.

Rotating the gear 12 retracts the projecting and retracting pin 10 into the supporting frame 30 and pulls off the distal end of the projecting and retracting pin 10 from the through-hole 55 and the locking hole 57. This operation releases the lock in the horizontal push-pull direction (direction in which moving near and away the underslab wall 2) of the wall panel 50. Now, the wall panel 50 is only in a state in which the vertical-position-adjusting mechanism 70 is received and supported by the supporting piece 60.

Figure 10:
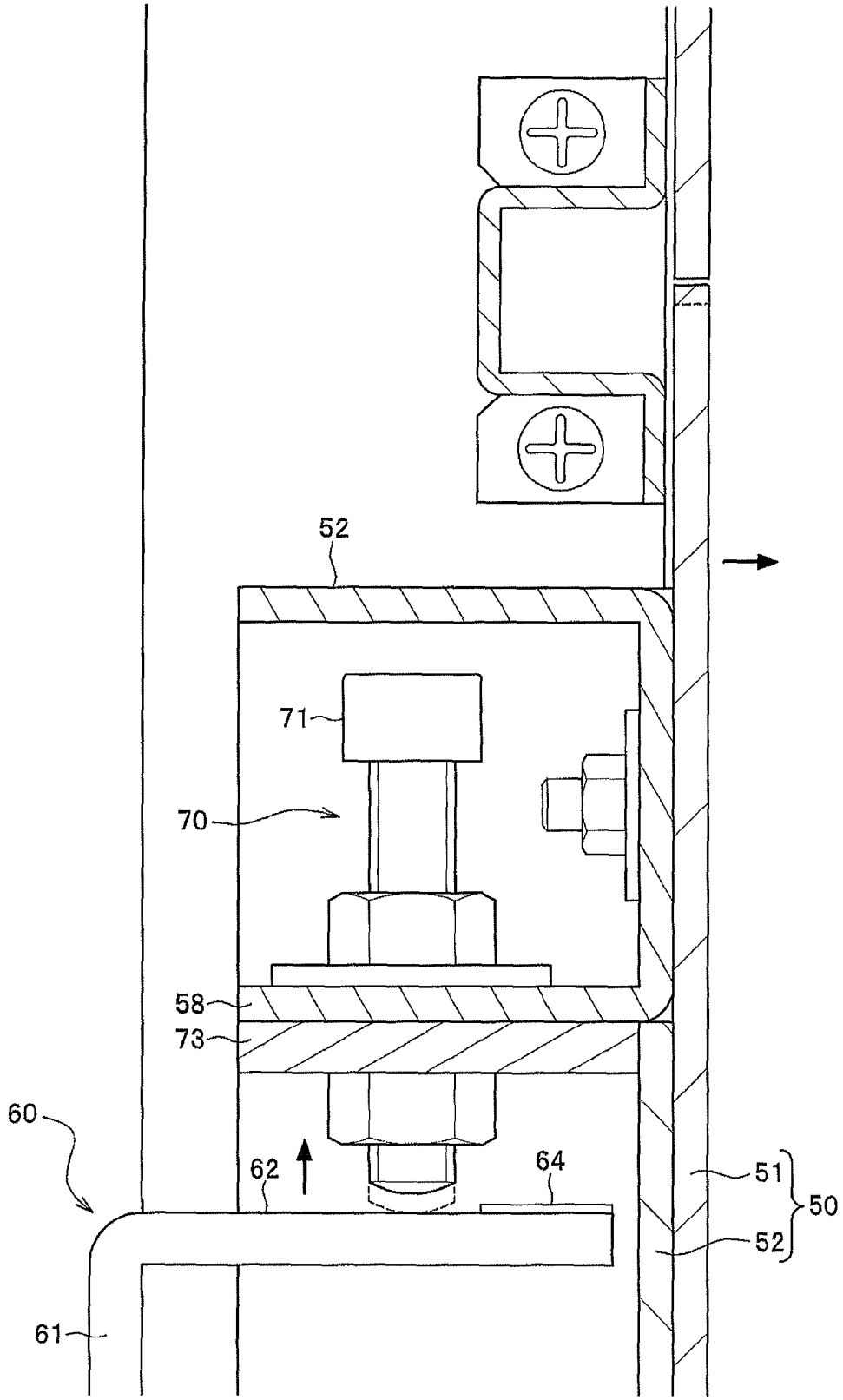
FIG. 10 is a diagram showing the upper end portion of the wall panel when demounting the wall panel, and is a sectional view showing a state in which the wall panel is lifted.

Next, the wall panel 50 is lifted slightly together with the suction device. As shown in FIG. 10, the lifting dimension is less than the width of the horizontal gap between the wall panel to be lifted and the upper wall panel 50, and is larger than the thickness of the plate 64. Then, the shaft end of the bolt member 71 rises from the upper surface of the receiving plate portion 62 and floats to a higher level than the upper surface of the plate 64. Then, pulling the wall panel 50 keeping the above height allows demounting the wall panel 50 while preventing the wall panel 50 from being caught by the bolt member 71.

As mentioned above, according to the present embodiment, the wall panel 50 can be demounted from the supporting frame 30 by releasing the lock of the wall panel 50 without shifting the other wall panels. Accordingly, since even the lower wall panel 50 can be mounted and demounted without shifting the other wall panels, the work and time for maintenance and replacement of the wall panel 50 can be drastically reduced. Moreover, according to the present embodiment, since the mounting position of the wall panel 50 is adjustable vertically and horizontally, the size of the gap 5 can be adjusted from the front surface of the wall panel 50.

In addition, since the accommodating space 31 is open to the gap 5, the projecting and retracting pin 10 can be projected and retracted by rotating the pin 10 through the gap 5 from the front surface of the wall panel 50. Further, providing the gear 12 to the head of the projecting and retracting pin 10 allows easy work to project and retract the projecting and retracting pin 10 even in the case of the narrow gap 5 (for example, approximately 2 to 3 mm) by inserting a thin plate type of rotational jig from the gap 5 into the accommodating space.

In addition, in the present embodiment, since the thread hole 32 is formed in the pin-supporting member 34 with the boss portion 33*a* separate from the supporting frame 30 and the pin-supporting member 34 is attached to the flange of the supporting frame 30, it is not necessary to form the thread hole directly in the supporting frame 30 that is an elongated member. Accordingly, this makes the work to form the thread hole 32 easy.

In addition, since the pin-supporting member 34 has the slant surface 37 formed so that the space to insert the frame member 52 of the wall panel 50 is configured to spread outward, the frame member 52 is hard to interfere with the pin-supporting member 34 when mounting the wall panel 50, thereby making it easy to push the wall panel 50 into a predetermined position.

Further, since the supporting frame 30 is provided with the supporting piece 60 and the wall panel 50 is provided with the vertical-position-adjusting mechanism 70, the vertical position of the wall panel 50 can be easily adjusted. Making the locking-hole 57 a vertically elongated hole allows securing a margin for vertical position adjustment. Moreover, in the present embodiment, since the locking hole 57 is formed in the position-adjusting plate 56, a margin for adjustment in the horizontal push-pull direction of the wall panel 50 can be obtained.

Since the vertical-position-adjusting mechanism 70 is configured to include the bolt member 71 and the thread-hole member 72, a vertical position of the wall panel 50 can be easily adjusted only by rotating the bolt member 71.

The foregoing describes the embodiments for carrying out the present invention, but the present invention is not limited to the above embodiments, and allows an appropriate change of design without departing from the scope of the present invention. For example, in the above embodiment, the load of the wall panel 50 is supported by placing the vertical-position-adjusting mechanism 70 on the supporting piece 60. The load of the wall panel 50, however, may be supported only with the projecting and retracting pin 10 without the vertical-position-adjusting mechanism 70.

Description of the Reference Characters

1 Wall panel fastening structure
10 Projecting and retracting pin
11 Thread portion
12 Gear
30 Supporting frame
31 Accommodating space
32 Thread hole
33*a* Boss portion
50 Wall panel
51 Wall board part
52 Frame member (fastening part)
57 Locking hole
60 Supporting piece
70 Vertical-position-adjusting mechanism
71 Bolt member

What is claimed is:

1. A wall panel fastening structure comprising: a wall panel, a supporting frame, and a projecting and retracting pin, wherein the wall panel is to be fastened to the supporting frame by using the projecting and retracting pin, and is provided with a wall board part and a fastening part projecting from a back surface of the wall board part; the supporting frame is provided with an accommodating space for accommodating the projecting and retracting pin, and placed along a gap between adjacent wall panels and facing to the fastening part;

the accommodating space is open to the gap; the projecting and retracting pin is provided with a threaded portion and an unthreaded, tapered front end portion, the threaded portion screwed into a threaded hole provided in a flange of the supporting frame; and the wall panel is locked to the supporting frame by inserting the unthreaded, tapered front end portion of the projecting and retracting pin into a locking hole formed in the fastening part.

2. The wall panel fastening structure according to claim 1, wherein a head of the projecting and retracting pin is provided with a gear configured to project and retract the projecting and retracting pin by inserting a rotation jig having teeth meshing with the gear into the accommodating space through the gap from the outside of the gap and by rotating the projecting and retracting pin.

3. The wall panel fastening structure according to claim 2, wherein the threaded hole is formed in a pin-supporting member provided with a boss portion that is separated from the supporting frame; and the pin-supporting member is attached to a flange of the supporting frame.

4. The wall panel fastening structure according to claim 3, wherein the supporting frame is provided with a supporting piece overhanging in the horizontal direction;

the wall panel is provided on the back side of the wall board part with a vertical-position-adjusting mechanism received by the supporting piece;

an abutting surface of the vertical-position-adjusting mechanism abutting with the supporting piece is configured to be movable up and down;

the projecting and retracting pin is accommodated in the supporting frame extending in the vertical direction and disposed so as to project and retract in the horizontal direction; and the locking hole is an elliptic hole elongated in the vertical direction.

5. The wall panel fastening structure according to claim 4, wherein the vertical-position-adjusting mechanism is provided with a bolt member extending in the vertical direction, and a member having a threaded hole into which the bolt member screws; and the abutting surface is provided on a front end portion of the bolt member.

6. The wall panel fastening structure according to claim 2, wherein the supporting frame is provided with a supporting piece overhanging in the horizontal direction;

the wall panel is provided on the back side of the wall board part with a vertical-position-adjusting mechanism received by the supporting piece;

an abutting surface of the vertical-position-adjusting mechanism abutting with the supporting piece is configured to be movable up and down;

the projecting and retracting pin is accommodated in the supporting frame extending in the vertical direction and disposed so as to project and retract in the horizontal direction; and the locking hole is an elliptic hole elongated in the vertical direction.

7. The wall panel fastening structure according to claim 6, wherein the vertical-position-adjusting mechanism is provided with a bolt member extending in the vertical direction, and a member having a threaded hole into which the bolt member screws; and the abutting surface is provided on a front end portion of the bolt member.

8. The wall panel fastening structure according to claim 1, wherein the threaded hole is formed in a pin-supporting member provided with a boss portion that is separated from the supporting frame; and the pin-supporting member is attached to a flange of the supporting frame.

9. The wall panel fastening structure according to claim 8, wherein the supporting frame is provided with a supporting piece overhanging in the horizontal direction;

the wall panel is provided on the back side of the wall board part with a vertical-position-adjusting mechanism received by the supporting piece;

an abutting surface of the vertical-position-adjusting mechanism abutting with the supporting piece is configured to be movable up and down;

the projecting and retracting pin is accommodated in the supporting frame extending in the vertical direction and disposed so as to project and retract in the horizontal direction; and the locking hole is an elliptic hole elongated in the vertical direction.

10. The wall panel fastening structure according to claim 9, wherein the vertical-position-adjusting mechanism is provided with a bolt member extending in the vertical direction, and a member having a threaded hole into which the bolt member screws; and the abutting surface is provided on a front end portion of the bolt member.

11. The wall panel fastening structure according to claim 1, wherein the supporting frame is provided with a supporting piece overhanging in the horizontal direction;

the wall panel is provided on the back side of the wall board part with a vertical-position-adjusting mechanism received by the supporting piece;

an abutting surface of the vertical-position-adjusting mechanism abutting with the supporting piece is configured to be movable up and down;

the projecting and retracting pin is accommodated in the supporting frame extending in the vertical direction and disposed so as to project and retract in the horizontal direction; and the locking hole is an elliptic hole elongated long in the vertical direction.

12. The wall panel fastening structure according to claim 11, wherein the vertical-position-adjusting mechanism is provided with a bolt member extending in the vertical direction, and a member having a threaded hole into which the bolt member screws; and the abutting surface is provided on a front end portion of the bolt member.

* * * * *